US005923252A

United States Patent [19]

Sizer et al.

[11] Patent Number: 5,923,252

[45] Date of Patent: Jul. 13, 1999

[54] AUDIO/VISUAL MARKETING DEVICE AND MARKETING SYSTEM

[75] Inventors: Geoff Sizer; Ian Wilson, both of Pymble; Michael Levy; Shun Thangathurai, both of Sydney, all of Australia

[73] Assignee: Marvel Corporation Pty Limited, Sydney, Australia

[21] Appl. No.: 08/793,155

[22] PCT Filed: Apr. 9, 1996

[86] PCT No.: PCT/AU96/00208

§ 371 Date: Feb. 21, 1997

§ 102(e) Date: Feb. 21, 1997

[87] PCT Pub. No.: WO96/31864

PCT Pub. Date: Oct. 10, 1996

[30] Foreign Application Priority Data

Apr. 6, 1995 [AU] Australia ..... PN2207

[51] Int. Cl.[6] ..... G08B 23/00

[52] U.S. Cl. ..... 340/573.1; 340/567; 340/692

[58] Field of Search ..... 340/540, 692, 340/567, 573, 546; 379/69, 89, 211, 212

[56] References Cited

U.S. PATENT DOCUMENTS

| | | | |
|---|---|---|---|
| 4,670,798 | 6/1987 | Campbell et al. | 360/12 |
| 4,849,635 | 7/1989 | Sugimoto | 250/342 |
| 4,912,457 | 3/1990 | Ladd . | |
| 4,984,098 | 1/1991 | Buntsis . | |
| 5,027,384 | 6/1991 | Morganstein | 379/67 |
| 5,117,217 | 5/1992 | Nykerk | 340/426 |
| 5,485,139 | 1/1996 | Tarnovsky | 340/573 |
| 5,532,680 | 7/1996 | Ousborne | 340/567 |
| 5,604,479 | 2/1997 | Chang | 340/384.7 |

FOREIGN PATENT DOCUMENTS

| | | |
|---|---|---|
| 0 421 941 A1 | 4/1991 | European Pat. Off. . |
| 2 703 499 | 10/1994 | France . |
| 092038 | 3/1992 | Israel . |
| 2 270 585 | 3/1994 | United Kingdom . |
| 2 279 750 | 1/1995 | United Kingdom . |

*Primary Examiner*—Jeffery A. Hofsass
*Assistant Examiner*—Anh La
*Attorney, Agent, or Firm*—Townsend and Townsend and Crew LLP

[57] ABSTRACT

The present invention relates to a device for delivering audio and/or visual messages for marketing purposes. The device comprises a detection means to detect that a person is present within a predetermined detection area, which may be proximate a product to be marketed, means for determining whether the person is interested in the product and means for delivering a message if it is determined that the person may he interested in the product. The determination means preferably comprises a means for timing how long the person stays in the detection area continuously. This time is a predetermined time period, then a message will be delivered. The device in accordance with the present invention is preferably able to be networked with other devices and/or includes an updatable memory so that control and message data can be updated from a central location in accordance with a marketing campaign. The device is also arranged to gather statistic information on the campaign.

12 Claims, 6 Drawing Sheets

AUDIO/VISUAL MARKETING DEVICE AND MARKETING SYSTEM

BACKGROUND OF THE INVENTION

The present invention relates generally to a device, method and system for delivering audio and/or visual messages, and, particularly, but not exclusively, to a device, method and system for delivering messages for marketing purposes.

Methods and devices for marketing are well known. They include advertising through communications media, billboard advertising, point of sale advertising (i.e. labelling, posters in retail outlets, etc) and many others.

One of the most important requisites for any advertisement is "effectiveness". Where effectiveness is defined by efficiency, impact and sales generation. An advertisement should be able to communicate to the target audience, for each specific product or service advertised, information that will sway their decision to a specific product category, service or brand, at the point where the product is purchased.

In order to achieve the above, an advertisement must have clarity, in terms of the quality of the message being delivered, efficiency in terms of generating the greatest number of sales on given advertising expenditure, and impact in terms of the advertisers ability to generate emotion within the purchaser, when the purchaser is making the purchase decision. Impact can be significantly increased where the message being delivered, is delivered at the moment in time within the consumers decision making process where it is most likely to generate the maximum number of sales.

Thus, the better an advertisement is at delivering a message, the better it is able to convey an emotion and generate a response, and the better an advertisement is positioned, (i.e., when the advertisement should be communicated) the greater the effectiveness of the advertisement, leading to greater sales of product.

The present applicants believe that impact can be increased by first of all establishing that a person or persons is likely to be interested in a particular product or service and then delivering a message to that person in audio and/or visual form. The message would not be delivered unless the determination that the person is interested has been made. The impact may be further increased by having the message "hidden" until it is determined that it should be delivered. By "hidden" the applicants mean that the message may not be perceivable to a person until it has been determined that that person is worth delivering the message to.

Impact and effectiveness can further be increased by being able to determine what point in time within each consumers decision making process, is the most effective point in time to be able to maximise effectiveness and thus generate the greatest response for any given advertisement.

A number of prior art devices attempt to detect the presence of a person and to deliver a message to the person on detection of their presence. The problem with the majority of such devices, however, is that they do not operate to discriminate between people detected by the device. The message will be delivered whether or not the person has indicated any particular interest in the message or whether or not the person would be likely to be interested in the message. This lessens the impact of the message.

No prior art devices have the ability to be able to deliver to a person a logical sequence of messages from start to finish. Where prior art devices exist which do deliver a sequence of audio and/or video messages, the devices are usually set to cycle through the sequence regardless of whether or not a person is present. Persons interacting with such devices will often approach a device while it is part way through its message cycle. The information will therefore mean very little to them or will be confusing. No prior art device exists which can ensure that a message sequence is delivered from the beginning of the message sequence on approach of a person.

No prior art device demonstrates the capability to be able to adjust specific timing of message delivery to be able to deliver to the purchaser the message at the point of time at which the message is likely to have the greatest effect.

Further, marketing of a particular product or products is often conducted by way of organised marketing campaigns. A client or retailer will often require a product in a retail area to be associated with a particular marketing advertisement, which advertisement may be updated from time to time. At present, there is no convenient way of automatically delivering and updating point of sale marketing campaigns, nor any convenient way of obtaining information on the effect of point of sale marketing campaigns. There is no device which enables a client to be able to evaluate their own point of sales campaigns, in terms of the ability for the point of sale campaign to generate interest, stopping customers, within retail, or other environment.

SUMMARY OF THE INVENTION

The present invention provides a message delivery device, comprising a detection means for detecting the presence of a person proximate a predetermined object or at a predetermined location, a determination means responsive to action of the person to determine whether or not a message should be delivered, and audio and/or visual message delivery means responsive to the determination means determining that a message should be delivered, to deliver a predetermined message.

The predetermined object may be a particular product type in a retail outlet. For example a particular type of wine or range of wines in a bottle shop. If a person stands in front of the particular brand of wine, for example, he will be detected by the appropriately arranged detector.

Detection is not sufficient on its own to cause delivery of the message. If this were the case the message would be delivered to people that where perhaps not interested in the product. For example, people merely walking past the wine, in the above example, although they may be detected should not be targeted for message delivery because they have not displayed any particular interest in the product type (the type of wine).

The determination means is arranged to monitor the action of the person in relation to the object or at the location to decide whether or not a message should be delivered. It may make this determination by using any number of different criteria. In the wine shop example, it may, for example, determine that a message should be delivered if the person opens the door of a fridge containing the particular wine type or range in question. In this case, the detection means can comprise a simple sensor for sensing the opening of the door. The determination means would be responsive to the detection means determining that the door was open to determine that the message should be delivered. In this case the determination means may be nothing more than a connection between the sensor and the message delivery means. The determination in this example is made immediately the door is opened.

In one preferred embodiment, the determination means comprises a timing arrangement for timing how long the detected person remains proximate the predetermined object or at the predetermined location and, if this time is greater than a predetermined time period, determining that a message should be delivered. In the wine example, if a person merely stands by the wine for a predetermined time it can be intimated that he is interested in the wine and the message would be delivered. In the preferred embodiment, the timing arrangement comprises a "barometer" which is arranged to be incremented each time a signal is received from the detection means indicative of a person being present in the detection area. Once a predetermined threshold has been reached in the barometer, it is considered that the person in the detection area has been standing there for sufficient time to cause message delivery.

A further alternative for the determination means is to have a sensor responsive to the person moving a particular product to deliver the message.

A device may use a combination of determination means to achieve a marketing objective. For example, the device could use the timing arrangement to determine that a message should be delivered to the individual in front of the wine fridge, as a purchase decision is being considered. This may then be followed by a reinforcement when the individual opens the fridge door, triggered by a sensor attached to the door. The device will deliver different messages according to the sensor that activated the device.

The determination means may take many forms. What is important is that the determination means is able to make a judgement, based on some predetermined criteria, that the person may be interested in the particular product and/or service (perhaps from among a range of the products or services) and is therefore worth delivering the message to. This judgement is preferably made without the person being conscious that any particular judgement is being made. This increases the impact of the subsequently delivered message.

Preferably, the device also comprises or is associated with a delivery time determination arrangement or process, for determining the optimum timing of delivery of a message to increase effectiveness of delivery of a message. In one form, this determination may be "short term". The device may monitor its performance and if it is not being "triggered" (so as to deliver a message) a minimum number of times in a given period of time, or is being triggered over a maximum number of times in a given period of time, for example, it may adjust the timing of the delivery of the message so that only a minimum or maximum number of messages are delivered over a predetermined period of time. In a "long term" determination method, information on the triggering of the device together with sales information for the associated product relating to the messages being delivered by the device, will be used to adjust the actual timing of message delivery to optimise it. Selective message delivery and message delivery timing increases the effectiveness of any advertising message.

The detection means may take many forms. In one preferred embodiment, it is an ultra sonic sensor arrangement that detects the presence of a person in a detection area. As discussed above, it may also comprise a door sensor in a fridge door or a door of any other type of storage container. It may comprise a pad positioned at a predetermined location and responsive to a person standing on it or touching it. It may comprise a pad underneath a product responsive to the person moving the product. It may also comprise a combination of any of these.

The content of the message may be anything. For marketing applications, however, the message will generally relate to a particular product or service available at the location at which the device is mounted. In the wine shop example, the message may inform the person of the price and quality of a particular brand of wine located where the person is standing. It may encourage the person to buy that particular type of wine.

The message delivered may also relate to products being cross-promoted. Thus in the wine shop example, the message may refer to a food product that should be consumed with the wine in question. Any message content can be used.

In a preferred embodiment, the message is an audio message. It is considered that audio messages may have greater impact than visual messages. The invention also, however, envisages delivery of visual messages or even a combination of an audio and visual message.

Further, a television monitor could be activated, a PC demonstration could be instigated, etc.

An advantage of not having the message delivered until a person is present and has been determined to be worthwhile delivering the message to, and seeking to deliver the message at the point in time where it is deemed to have greatest impact, (i.e. having the message "hidden") is that, it is believed, the message has greater impact when delivered in this way. It also has the added benefits of minimizing noise pollution and aggravation to customers and proprietors which could occur if the device was continuously delivering messages to all who pass by.

It also ensures that the advertisement is communicated to individuals interested in the advertisement, thus not damaging any reputation held by a product or service, which may occur if the message were delivered to those who are not deemed a likely target.

The device may be able to select from a plurality of pre-stored messages.

When a plurality of messages are stored, the device may select which message to deliver on a random basis, or in a predetermined order.

Where a message has been delivered and a person is still present proximate the predetermined object or at the predetermined location, it is generally undesirable to have the device issue a further message straight away. This would, we believe, lessen the impact of the originally delivered message. The device is therefore preferably arranged to wait for a predetermined time following the delivery of a message before delivering any further message, even if within that time the person remains standing proximate the object or at the predetermined location, to allow the recipient of any communication the opportunity to be able to respond to the advertisement.

Preferably, pre- and post-message delays are set for the device so that messages are not delivered in quick succession. In a preferred embodiment, the pre- and post-message delays are adjustable. They may be adjustable manually and/or automatically. Automatic adjustment may occur in response to predetermined criteria, according to the particular environment that the device operates within and the particular effect that the user wishes to deliver to target individuals. The adjustment facility of the pre and post-message delays enables the unit to be easily adjusted to ensure that the message is delivered at the point in the consumers decision making process most likely to generate the greatest results.

For example, where a predetermined sequence of messages may be stored in the device and delivered in accordance with the sequence, there may be a preset pre and post-message delay depending upon the position of the message to be delivered in the sequence, which may be pre-set depending on message content.

Further, during periods of heavy customer traffic, the device may be arranged to increase its pre- and post-message delay times to prevent the device from activating too often.

The device of the present application has many applications, particularly within marketing but not limited thereto.

For example, the device can be used to detect a person "browsing" for a particular product in a retail outlet and to deliver a message on determination that the person is browsing. The device can be used to deliver a message to a person putting petrol in his car at a petrol bowser, possibly advertising products available for purchase within the petrol station.

The device could be used at a service outlet for advertising particular services. The device may be installed outside a retail outlet, to detect the presence of a person looking through a window of the retail outlet, for example, to deliver messages to entice the person inside.

The device may be installed in a museum or art gallery to provide information on a particular exhibit.

The device may be responsive to a person standing close to the edge of a train platform for too long, to deliver a safety message.

The device may be installed within a security area to seek to deter individuals from loitering in such places, while not being an actual alarm system. The device may be installed in traffic lights at pedestrian intersection that have shown to be dangerous in terms of accidents occurring.

The above are just a number of examples of the many applications available for the present invention.

A device in accordance with a preferred embodiment of the present invention may have any of the following additional optional advantageous features.

The device may include a volume control means responsive to the detection means detecting that a person is no longer present, during delivery of an audio message, to reduce the volume of the audio message or to cease delivering the messages, and to reset the device so that it will subsequently commence message delivery from a predetermined point (ie. predetermined message in a sequence of messages, or, where only one message is stored, from the beginning of the stored message). The device is thus only delivering a message when a person is there to receive it.

The device may be arranged to be connected to other external devices which may then be operated ancillary to the message delivery process. For example, the device may activate mechanical objects to move, may activate interactive PC based demonstrations, etc. The device may deliver combinations of audio, visual and/or mechanical (eg. objects moving) messages.

The device is preferably arranged to continuously monitor its immediate environment (its environment within the detection area of the detection means) to look for "static" changes. By "static" changes are meant changes to the environment which will remain in place for relatively long periods of time. For example, in a retail store aisle, placing packaging boxes within the detection area for a relatively long period of time would be a "static change". It is desirable that the device not deliver messages continuously because of detection of such static objects. The device, therefore, is preferably arrange to determine, that the change in its environment is in fact a static change and not to react by delivering messages.

The device may also include means for assessing characteristics of a personal detected by the detection means. It can use knowledge of these characteristics to control message delivery. One characteristic which may be determined is the height of the person. Knowledge of height can indicate, for example, whether the person is an adult or a child and an appropriate message can be selected for delivery. The technology is also available to read "Smart" Cards or RF Cards carried by the person. Such cards may contain demographic and psychographic information on the person and this information could be used by the device to select messages for delivery. Although Smart Cards and RF Cards are not widely used at present, it is envisaged that in future they will become ubiquitous.

The determination means may also include a directional sensing means to determine the direction of approach of a detected person. Message selection can then be controlled accordingly. For example, the device might be arranged to deliver a message which refers to items situated further up the aisle in a retail store in the direction which the person is heading.

The detection area of the detection means is preferably variable. It may be manually adjustable, so that the end user can preset the detection area according to the devices immediate environment, or automatically adjustable so that, for example, the device can automatically adjust its detection area to suit its environment.

The device is also preferably arranged to detect and distinguish between different individuals in the detection area. For example, shopper 1, at a predetermined first distance from the unit, remaining for only a short period of time, is not confused with shopper 2, who is at a predetermined second distance from the unit and enters the unit's field of view as shopper 1 leaves. Because the device discriminates between these two shoppers, it prevents false trigging of message delivery. In a preferred embodiment, this discrimination is achieved by using ultrasonic sensors and means for analysing the signal received by the ultrasonic sensors to determine whether more than one person is present and their position in the detection area. The determination means then determines the time that each shopper remains in the detection area and controls message delivery accordingly.

As discussed above, the device is preferably arranged to store a plurality of messages which may be delivered in predetermined sequences. Selection of the message to be delivered and sequencing of messages may be controlled in accordance with a number of predetermined criteria. For example, messages could be delivered in accordance with some preset communication strategy, or as a function of time of day and date (certain messages to be delivered in the morning, certain messages in the evening, certain messages to be delivered on Christmas day, etc.) a real-time clock is preferably included in the device to enable the device to determine the date and time of day.

As discussed in above, one of the most effective and most used ways to sell a product or service is to conduct a marketing or promotional campaign. Such campaign may be conducted on an intra-store or nation wide basis and may include a series of advertisements periodically updated in accordance with a promotional plan.

The promotional plan will usually include other media including radio, print and television.

In a preferred embodiment, a device in accordance with the present invention is particularly suited to conducting organised marketing campaigns. The device preferably includes communication means enabling the device to communicate with other like devices and/or a central controller. Messages and even operating instructions can be transmitted via a communication system to update operation of individual devices. A marketing campaign utilising such "networked" devices may be conducted from a central location. The communication means may include conventional networking of the devices, e.g., by RS-485 interface and MODEMS, or by removable memory means which is arranged to be connected to each device, such as a removable flash-memory card. The memory means can be up loaded with new message and control information at a remote location and then distributed to each of the devices.

Campaigns can thus be managed on a national level in accordance with activities occurring on other mediums.

Another preferred feature of the device is the provision of a statistical gathering and storage means for gathering and storing statistical information on the operation of the device. Such information preferably includes the number of times the persons are detected and the number of times a message is delivered. This information can be used to determine the ratio of persons passing by the product and persons browsing by the product (to whom the message is delivered). Other information on the operation of the device may also be stored. This statistical information is useful in determining subsequent operation of the device and, where a networking communications capability is available, is useful in conducting marketing campaigns. Message delivery can be adjusted in response to the statistical information gathered by the device.

Devices may also be arranged to be connected to operate together. For example, one unit may be at the front end of a display (running along the shopping aisle) and the other unit at the back end. When a shopper walks along the display the first unit will deliver one message and the second a different message, the devices interfacing with each other to ensure that the messages are coordinated.

From a further aspect, the present invention provides a marketing arrangement, comprising a plurality of marketing devices including any or all of the features discussed above, and each device including a communication means enabling it to have message data and/or control data communicated to it from a remote location.

The communications means may include a connection to a network and/or a removable non-volatile memory, such as a flash card memory.

Such a system can advantageously be used to conduct organised marketing campaigns for promotion of products and/or services. Each device on the system may be periodically updated with control instructions (data) and/or message information (data) to enable it to operate in accordance with the marketing plan. Further, the devices may include a statistical gathering operation and may be able to down load the statistical information to the central location to enable the marketing campaign to be adjusted in accordance with information provided by the statistics.

Preferably, each device connected to the system has an individual identification address, which enables it to be individually addressed by a central controller. The central controller may thus send out updates tagged by address to ensure that the appropriate device is updated. As discussed above, the updates may be sent out by removable non-volatile memory or sent out on a network to which the devices are connected, e.g., by MODEM.

Such a system also enables "wild card" campaign operation. For example, all units operating within a particular retail chain may, on instructions from the retailer, receive message information and instructions to deliver a message such as "the retailer wishes you a very merry Christmas".

The device and system in accordance with the present invention advantageously enables marketing campaigns to be conducted with much greater efficiency than previously and with much greater impact on the target person. The campaign has the advantage of being directional in the sense that the devices are all arranged to deliver messages only to people who are perceived to be interested in the product/service being marketed; the marketing system is also responsive, as the devices are able to provide information on the number of operations compared with the number of people passing by the device, and message delivery and operation can easily be updated from a central location to carefully govern the marketing campaign accordingly. No such system has been proposed or suggested before, combining directionality with up datability and responsiveness.

From a further aspect, the present invention provides a method of delivering predetermined message, comprising the steps of automatically detecting the presence of a person proximate a predetermined object or at a predetermined Location, automatically determining from action of the person whether or not a message is to be delivered, and automatically delivering an audio and/or visual message in response to a determination that a message should be delivered.

From yet a further aspect the present invention provides a method of operating a system comprising a device or devices having any or all of the features of the device discussed above, including the steps of periodically updating message information and/or control information, whereby to facilitate conducting a marketing campaign for a product/service.

Preferably, the method includes the step of down-loading statistical information gathered by the device or devices, whereby to ascertain the effect of and enable adjustments of any such marketing campaign.

The method of operating the system preferably comprising making a determination, from down loaded statistical information and/or other information gathered on the marketing campaign or event, as to the optimum timing of delivery of a message or messages being delivered by the device in the marketing campaign, and making adjustments to the pre and/or post-message delays for the message or messages to the determined optimum delivery time.

BRIEF DESCRIPTION OF THE DRAWINGS

Features and advantages of the present invention will become apparent from the following description of embodiments thereof, by way of example only, with reference to the accompanying drawings, in which.

DESCRIPTION OF THE PREFERRED EMBODIMENTS

Figure 1:
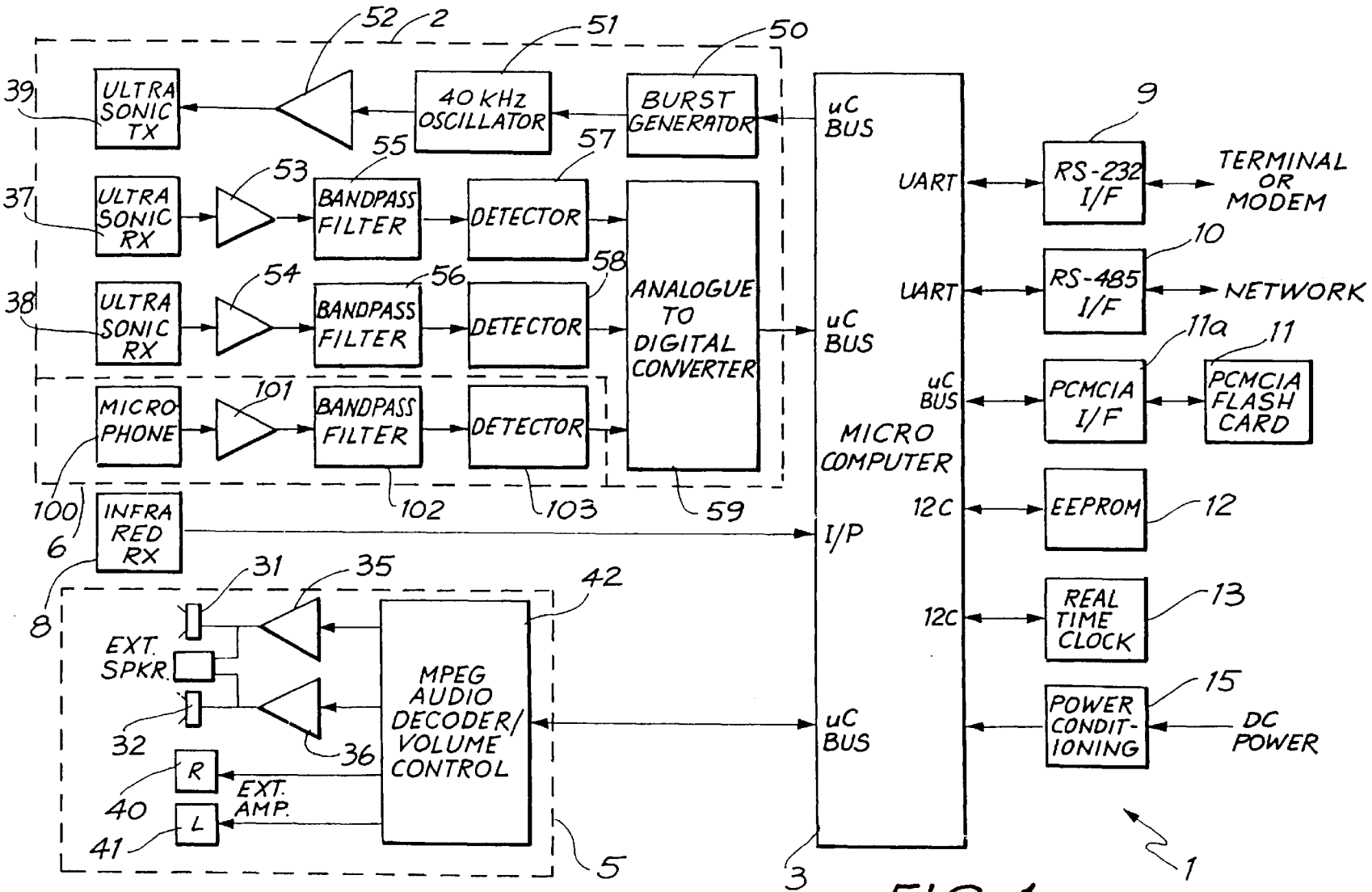
FIG. 1 is a block circuit diagram of a device in accordance with an embodiment of the present invention.

With reference to FIG. 1, a message delivery device, designated generally by reference numeral 1, comprises a detection means, in this embodiment being an ultrasonic target sensor 2; a determination means for determining whether or not a message should be delivered responsive to action of a person detected by the sensor 2, the determination means in this embodiment comprising an appropriately programmed microcomputer 3, connected to receive signals from the target sensor 2, and a message delivery means responsive to the determination means determining that a message should be delivered, to deliver a predetermined message, the message delivery means in this embodiment comprising an MPEG decoder and amplifier and speaker arrangement 5. The MPEG decoder is also capable of decoding a video MPEG encoded data.

The microcomputer 3 governs all operation of the device 1 and is programmed to provide all desired functionality of the device, in association with the peripheral components.

A device of the present invention may be used in any number of message delivery applications, as discussed above, but it is preferred for use in marketing applications, particularly point of sale marketing applications.

The device also comprises a background noise sensor arrangement 6. The arrangement 6 allows detection of background noise levels. The microcomputer 3 is arranged to adjust the volume of output of audio messages by arrangement 5 taking into account background noise levels. Volume may also be adjusted manually.

The device 1 also comprises an infra-red interface 8 which enables set up of the device and programming by installers and operators using an infra-red transmitter.

An RS-232 interface 9 is provided. The RS-232 interface 9 enables interfacing with ancillary devices such as alphanumeric message displays, control of peripheral electromechanical devices, interfacing with a PC, interfacing with a modem and any other RS-232 operations.

An RS-485 interface 10 is also provided to enable networking of a plurality of devices 1 and/or a plurality of devices 1 and a central controller.

A removable memory module 11 and interface 11*a*, in this case a PCMCIA-flash card and memory and interface, is provided for the storage and distribution of digitised messages and unit control instructions.

An Electrically Erasable Programmable Read Only Memory (EEPROM) 12 is provided to store control instructions for the device 1, which instructions may be updated from time to time.

A real-time clock 13 is provided for time keeping and scheduling functions.

A power conditioning unit 15 conditions the input power supply and provides power at the required levels to the various components of the device 1.

In operation as a point of sale marketing device, the device 1 will be positioned appropriately with regard to a product to be marketed or where a service is to be marketed it will be positioned appropriately with regard to a service outlet. For example, in a retail store, the device 1 may be positioned adjacent products to be marketed, such as bottles of particular brands of wine, for example. Note that the device is not limited to point of sales marketing and may be positioned conveniently anywhere where it is desired to deliver a message. The present description, however, is in terms of a point of sale marketing device positioned proximate a product to be marketed.

Figure 2:
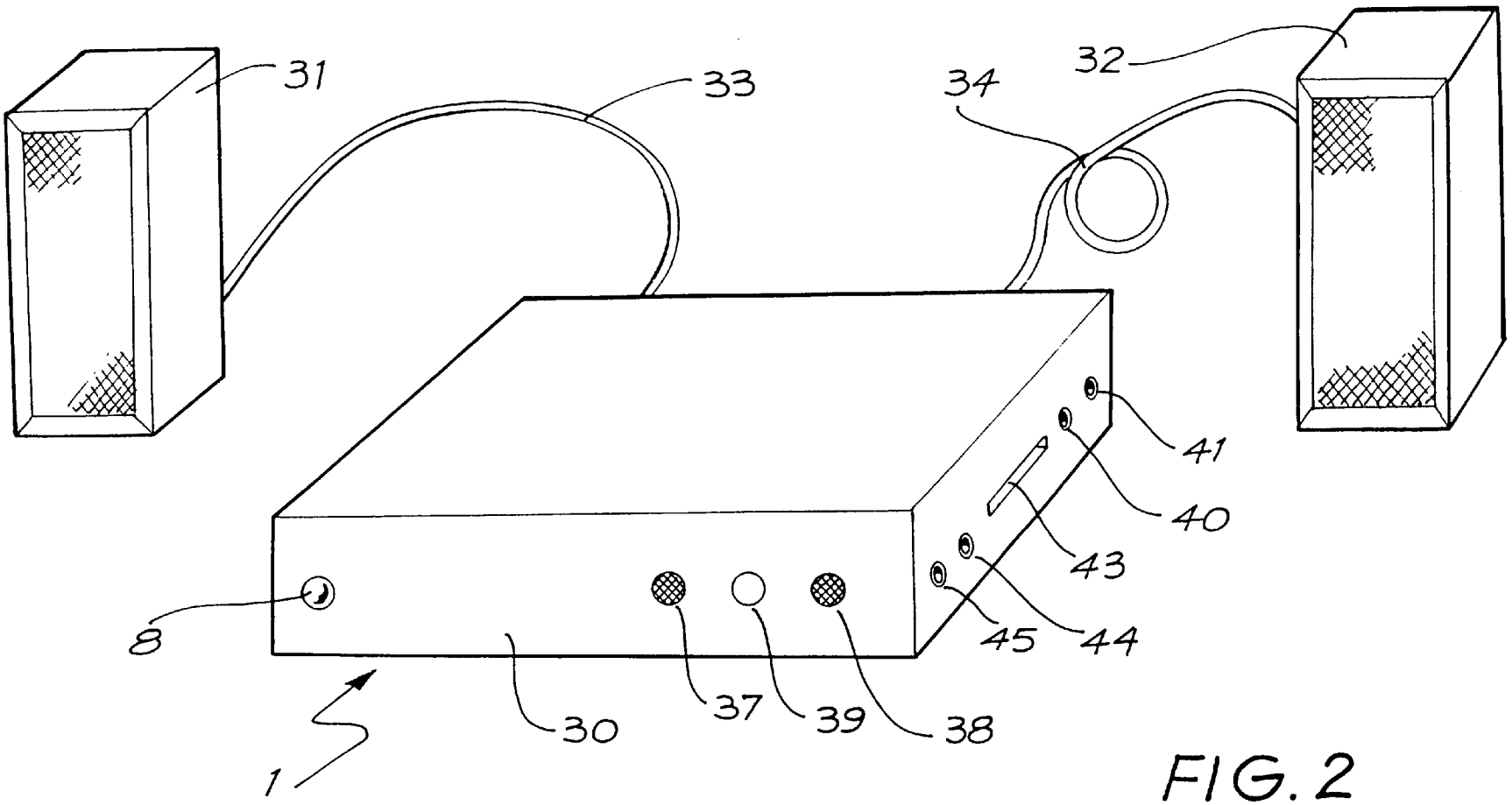
FIG. 2 is a perspective view of an embodiment of the device.

FIG. 2 illustrates in perspective view an embodiment of a device in accordance with the present invention. The device 1 (note that the same reference numerals are used for the same components as in FIG. 1) comprises a device housing 30 which houses the components shown in FIG. 1. The housing 30 is connected to two external speakers, 31 and 32 via line connections 33 and 34 and plug-in sockets (not shown) in the back of the housing 3, connecting to audio amplifiers 35 and 36 (FIG. 1).

The front face of the housing mounts ultrasonic receivers 37 and 38, ultrasonic transmitter 39 and infra-red receiver 8. In operation, the unit 30 is positioned proximate the product to be marketed, with the ultrasonic transmitter 39 and receivers 37, 38 positioned with a clear view of the detection area.

Another face of the housing 30 mounts plug-in sockets 40 and 41 for connection of an external amplifier to the MPEG audio decoder 42 (FIG. 1). In an alternative embodiment connections (not shown) for video output from the MPEG decoder may also be included. This face of the housing 30 also mounts a slot 43 for receipt of the PCMCIA flash-card 11, and RS-232 and RS-485 connection sockets 44 and 45.

Although the device 1 has been shown in a single unit housing 30 with connected external speakers 31 and 32, it will be appreciated that the device 1 may be housed in any form and need not be housed in a single unit. For example, the transmitter and detectors 37, 38, 39 could be placed in a separate unit away from the rest of the device 1, for convenience of mounting. Many configurations are possible.

Referring again to FIG. 1, the device 1 is arranged to deliver a message pertinent to marketing of the associated product. As discussed above, it is important that the message not be delivered indiscriminately. To maximise impact, messages should be delivered only to people whom it is considered are likely to be interested in receiving the message and the timing of message delivery should also preferably be arranged to give optimum impact.

The detection means 6 and determination means 3 are arranged to operate so that the device 1 delivers messages only to "targets" (persons within the detection area of the detection means 6) who satisfy predetermined criteria. Operation of the detection means 2 and determination means 3 will now be described in detail with reference to FIGS. 1 and 3.

The detection means 2 comprises an ultrasonics transmitter and receiver arrangement. Ultrasonics works in a similar manner to sonar. Ultrasonic pulses are transmitted into a detection area and objects within the detection area reflect the pulses towards the detectors. The received signal can be processed to provide information on targets within the detection area.

The transmitter arrangement comprises a burst generator 50 which, under control of the microcomputer 3 via the microcomputer BUS, is arranged to generate a 1 ms pulse to 40 kilohertz oscillator 51. Thems pulse duration is adjustable. A series of 40 kilohertz pulses lasting typically 1ms is produced at the output of the oscillator 51 and amplified by amplifier 52. Ultrasonic transducer 39 outputs a 1ms 40 kilohertz ultrasonic signal. These 1 ms burts can be produced as frequently as required, under control of the microcomputer 3. In this embodiment, the pulses may be produced in a range of 1 per second to 10 per second, the frequency being adjustable within this range. Four pulses per second has been found to be satisfactory for most applications. In general, the frequency at which the pulses are produced can be selected depending upon the time response required. Reflections from any targets within the detection area will impinge on receivers 37 and 38. The received signals are amplified by amplifiers 53 and 54 which also apply a variable gain function, then band pass filtered by filters 55 and 56 to removed unwanted high and low frequency components and passed to detectors 57 and 58. Detectors 57 and 58 rectify the respective signals from receivers 37 and 38. The strength of the signal depends on the distance to the target and reflection coefficient of the target. The variable gain is applied so that gain increases as a function of time to compensate for the loss in received signal strength with distance to target. The signal is therefore gain compensated. The signals are input to analogue to digital converter 59 which samples the incoming signals every 250 ms to produce a digital representation of the signals which is passed onto the microcomputer BUS for processing by the microcomputer 3. The microcomputer 3 comprises a microprocessor, in this embodiment a phillips P80C32EBPM microprocessor, with RAM, ROM, and other components (not shown separately) necessary for the operation of the microcomputer, as will be understood by the person skilled in the art. The microcomputer is arranged to process the signal to make a determination as to whether any target detected by the detection means should give rise to delivery of a message by arrangement 5.

The provision of two ultrasonic receivers 37 and 38 allows space diversity operation. The signals from both receivers can be combined t reduce the likelihood of false triggering of the device because of false echoes. In this embodiment, the signals are combined by alternate sampling of each signal in the A-D converter 59.

In alternative embodiments, AND functions or OR functions may be applied. In other words, with an AND function the signal value will only be passed if both receive signals are over the value and with an OR function it will be passed if only one of the receivers has the value. Other processing may be used and further sensors may be used (see later).

The detection area is a cone extending in front of the unit from an apex located at the sensing element area 37, 38. The maximum angle of detection relative to the cone apex is preferably pre-settable and may be settable the operator via the infra-red receiver 8 (see later). The maximum range of detection is also operator settable via the infra-red receiver 8 between 0.5 to 10 meters. It will be appreciated that a device in accordance with the present invention may have any range.

The range of the device can be set manually or through control data provided to the device via the various interfaces. The device allows the operator to adjust the range settings for the particular detection area required. For example, in a supermarket environment, the device may be promoting products that are placed on one side of the supermarket aisle. Thus the detection area will be adjusted so that only targets who come close to the side of the aisle where the device is positioned, will receive messages. The adjustment ability means that the unit can be stored in many and varied retail environments, covering different detection areas.

The device also includes means for setting a minimum range setting, within which range the device will ignore any reflected signals. The device could therefore be placed behind products on a shelf and actually be hidden or partially hidden from view of the target person. Although the sensors must have a clear field of view at least to the front, the minimum setting means that any reflections from products placed on either side of the sensors within the detection cone will be ignored. This is achieved by programming the micro computer to process the return signal ignoring signal returns within a predetermined time, corresponding to the minimum setting. The maximum range is similarly controlled. The angle of detection may be controlled by physically positioning the sensors and/or using ultrasonic lenses.

Once the received signal has been sampled and converted by A/D converter 59, further normalisation and filtering of the signal is carried out by the microcomputer 3 in accordance with programs stored in its ROM, to reduce noise effects, as is known in the art of ultrasonic signal processing. The microcomputer processes the received signals to determine whether or not a message should be delivered by arrangement 5.

Figure 3:
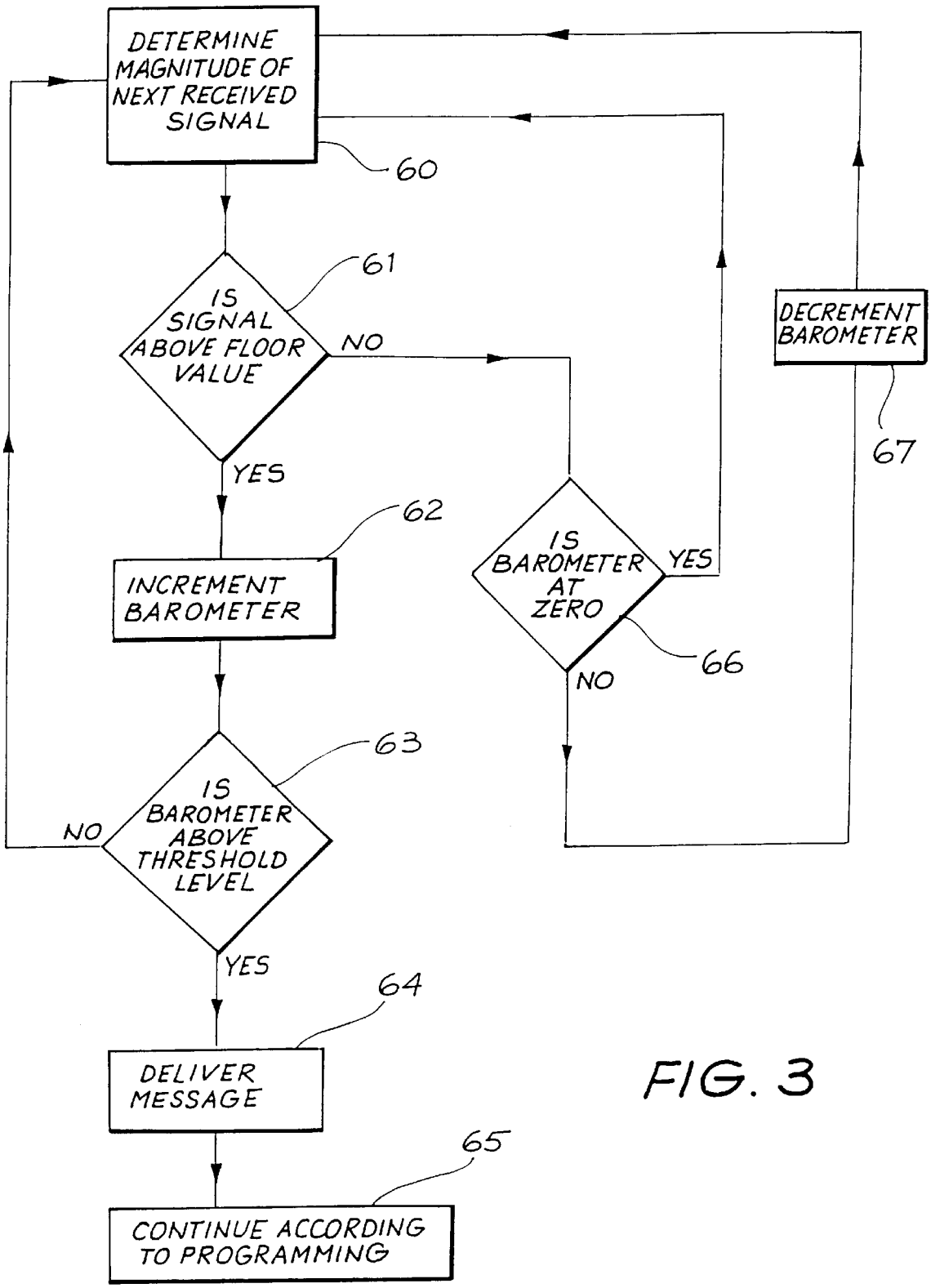
FIG. 3 is a flow diagram showing operation of a detection mechanism and determination means in accordance with an embodiment of the present invention.

FIG. 3 is a flow chart illustrating the process carried out by the microcomputer 3 operating as a determination means to determine whether or not a message should be delivered in response to the detection means detecting that a target is present. In general, if a signal is received which indicates that a target has moved into the detection area, then a "barometer" is incremented until a set threshold level is reached. The threshold level is determined depending upon the time required for the target to be present before the message is to be delivered (the "pre-message delay"). Once this threshold is reached, the microcomputer controls the arrangement 5 to deliver a message.

In more detail, referring to FIG. 3, at step 60, following further processing of the received signal by the microcomputer 3 to further normalise the signal, a determination of the magnitude of the received signal is made. A "signal floor value" is set by the microcomputer (see later) and at 61 the magnitude of the received signal is compared with the floor value. The floor value is set on the basis of the strength of signal which was being received before the latest signal was received, so if there is an increase in the signal above the floor value, it is indicative that a target has moved into the detection area of the device 1. This causes the barometer to be incremented, step 62.

As discussed above, a threshold level is set in accordance with what pre-message delay is required, which will govern how long the target needs to be within the detection area before a message is delivered. At step 63, a comparison is made to see whether the barometer is above the threshold level. If not the microcomputer returns to step 60, with the barometer maintained at its new, incremented level. If yes, and the target has remained in the detection area sufficient for the barometer to be incremented to the threshold level, then the microcomputer 3 controls the arrangement 5 to deliver a message, step 64.

Following message delivery, the process continues according to the operating instructions of the device 1, step 65 (see later).

When a target initially moves into the area, the barometer should be at zero. In general, a number of signals will be sent out by the ultrasonics every second, and the corresponding number of reflections will be received from the target every second. It will take a predetermined number of signals received from the target to increment the barometer to the threshold level. The timing of the delivery of the message will therefore be determined in relation to the number of received target signals required to increase the barometer to the threshold and the frequency of transmission of the signals by the ultrasonics.

If the target moves away before the barometer has increased to the threshold level, obviously it is not desirable that a message be delivered. When the target has moved away, however, the received signal will no longer be above the floor value and the operation will proceed from step 61 to step 66 where a determination is made as to whether or not the barometer is zero. If a target has been in the area the barometer will not be zero and the microcomputer 3 will proceed to decrement the barometer, step 67 before returning to step 60. If no target was ever in the area, then the barometer will be zero and the microcomputer will merely proceed back to step 60.

Where a target is moving around, it is possible that he may move in and out of the detection area or may move in such a way that one or more signals received may not be above the floor value even though the target is in the detection area. To take this into account, when the barometer is incremented, it is incremented by two units and when it is decremented, it is decremented by only a single unit. In other words, the barometer decrements slower than it increments to take into account the fact that a target may be moving around, resulting in spurious signals.

A number of options are available for step 65, according to the programming of the device 1. These will be explained in more detail later, but include delivery of a further message in a sequence, or repeating the original message if only a single message is to be delivered by the device. Both these options are governed by whether or not targets are present in the detection area. It is not desirable to deliver messages when no targets are present. It is also not particularly desirable to continue delivering the same message to the same person, nor is it desirable to continue delivering messages to targets which are not people i.e. static objects which have been moved into the detection area, i.e. crates of boxes moved into the supermarket aisle. To avoid these problems, the device 1 is arranged to "learn" about its environment. This embodiment does this by varying the floor value in accordance with its environment and according to control parameters relating to message delivery. The floor value is not fixed. If it were, messages would continually repeat if a person continues standing in front of the device 1 or if an object is moved in front of the device 1 which causes a signal to be produced which is above the floor value.

Figure 4:
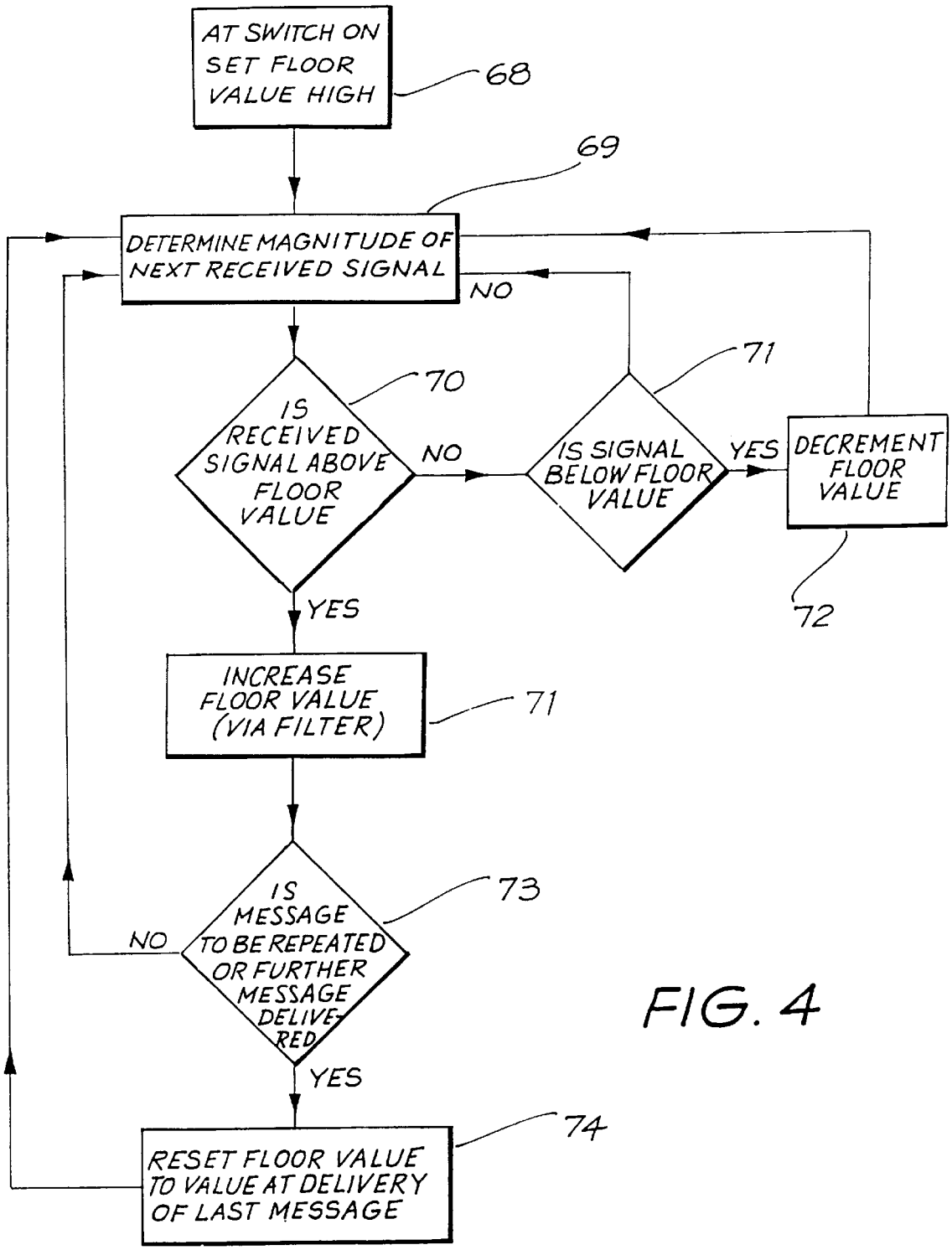
FIG. 4 is a further flow diagram illustrating further operation of the determination means.

FIG. 4 illustrates operation of the microcomputer 3 in controlling the floor value and therefore enabling the device 1 to learn about its environment and adjust the floor value for optimum message delivery operation.

At switch on, the floor value is set high, step 68. It is actually set higher than any signals which are likely to be received from the detection are at switch on so that no messages will be delivered until the device has "settled". As the device operates, in the next step 69, the microcomputer 3 determines the magnitude of the next received signal. If the received signal is not above the floor value, step 70, which it will not be at switch on, then a further determination is made as to whether the signal is below the floor value, which it will be at switch on, step 71, and, at step 72 the floor value is decremented. From there the processing returns to step 69. Thus, at switch on, the floor value will rapidly decrement via step 69, 70, 71 and 72 until the floor value is set by the signal value which is actually being received from the detection area. At step 71 it will finally be determiner that the signal value and the floor value are the same and will proceed directly to step 69 without decrementing the floor value any further. If somebody happened to be standing in the detection area at switch on, when they move away the floor value will re-set itself by going via step 72 until the new, lower floor value is reached. Any packaging or other "static" targets in the area will be automatically taken into account as they will be taken into account by the received signal value. From now on, only changes in the signal value will effect the barometer (FIG. 3) and the floor value.

Once the floor value has settled from start up, the processor continues circling through the loop 69, 70, 71 until a signal is received which is above the floor value. This will be processed in accordance with FIG. 3, affecting the barometer and message delivery, but will also affect the floor value in accordance with the process illustrated in the rest of FIG. 4. If at step 70, it is determined that the received signal is above the floor value, then at step 71 the floor value will be increased. If the floor value increases at the same rate that the barometer increments towards the threshold level, however, it would prevent the barometer incrementing, as a person remaining in the area would eventually not affect the barometer because the signal would be seen not to be above the floor value. In other words the floor value would have caught up with the received signal. To prevent this, the floor value is only increased relatively slowly, by applying a digital filter to delay the increase of the floor value. The floor value therefore tracks the signal value, but only slowly. The increase in the floor value is much slower, therefore compared to the frequency of receiving signals, so that the device has plenty of chance to increment the barometer to the threshold level and deliver a message before the floor value reaches the signal value which is being provided by the target.

Following message delivery, if the control instructions and message data dictate that no further messages to be delivered or that the message is not be repeated to the same target, then the floor value is set to the signal level at the time the message was delivered (not shown in flow diagram FIG. 4). This will prevent the barometer from incrementing and will prevent any further message delivery while that person remains there. He will have to leave before the floor value can be decremented to await another target. If the target moves away, the floor value will be quickly decremented via path 71 and 72 to await detection of a further target. Minimal filtering is applied to the floor decrementing step, so it is as quick as the frequency of the received signals and as quick as the process of FIG. 3. If a target is not a person, but a crate of boxes or any other type of static objection which has been moved into the detection area, the floor value will stay where it is and, although moving into the area of the static object may initially give rise to message delivery, after the floor value has been increased to the new signal value level, message delivery will cease. Device 1 has "learned" that the target moved into the area is a static change in the detection area and no message delivery is required. Should a further, genuine, target move into the area subsequently, then a signal of greater magnitude than the static signal will be provided to the microcomputer and the operation of FIG. 3 will take effect to cause message delivery to the new target, comparing the new signal with the new increased floor value.

In some cases, it may be required that a sequence of messages be delivered to a single target, or that even a single message be repeated a number of times to the same target. The present embodiment makes allowance for this. At step 73, it is determined whether a message which has been delivered is to be repeated or whether a further message (e.g. within a sequence of message) is to be delivered. If no message is to be repeated and no further message to be delivered, then the floor value is set to the present value and the processing merely returns to step 69 and operates as discussed above. If, however, it is determined that a further message is to be delivered or a message to be repeated to the same target, then at step 74 the floor value is re-set to the value it was prior to detection of the target which triggered delivery of the previous message. Re-setting the floor value means that the whole process will start again, even though a new target has not moved into the area.

Eventually at step 73 it will be determined that the message has been repeated enough times or that all the messages in the sequence have been delivered and that no further message is to be repeated or other message to be delivered, in which case the floor value will then be set at its increased level, until the target is removed. This process will be governed by the programming of the device 1 (see later).

In accordance with the above process, the device thus applies discrimination in determining whether or not a message should be delivered to a person who has been detected. By applying the barometer process, the device discriminates between shoppers who are merely passing by the device and people who are browsing and therefore, are impliedly interested in the product positioned proximate the device.

This arrangement for message delivery, therefore, has "impact" on shoppers who have impliedly expressed an interest in a product. As discussed in the preamble, the device also envisages other methods of discrimination, such as movement of product (detected by a sensing pad connected to the device), opening of a container, eg. a fridge containing product, and other discrimination methods. A number of different discrimination methods may be used together to control message delivery. For example, the first message in a sequence of messages may be delivered when the target has been detected for the threshold period and a second message delivered only when the target opens a container, e.g. fridge door.

If the person should leave the detection area during message delivery, it is desirable that message delivery volume be reduced or message delivery cease altogether. There is no point in having the device delivering a message when nobody is there to hear it. This can be achieved by monitoring the returned signal value. On detection of a target entering the area, the signal value will increase to a certain level. Should the target leave the area, the signal value will decrease. If the signal value reaches the signal value which existed immediately before the target entered the area, the microcomputer determines that the target has left the area and controls message delivery to either wind down the volume or ceases message delivery, and re-sets the device to await a further target. If the targeted person should leave during a sequence of messages, the device will be re-set at the beginning of a message sequence. This may occur from any point within a message sequence.

Referring again to FIG. 1, the background noise sensor arrangement 6 comprises a microphone 100, an amplifier 101 and band pars filter for filtering the audio signal, 102 and a detector 103. The background noise signal is converted to digital in A to D converter 59, and is used by the microcomputer to determine the optimum volume for message delivery. The volume of message delivery may also be governed by control data or set by the operator via infra-red receiver 8. The background noise detector can be used by the microcomputer to cause an increase or decrease in the volume within bounds set by the operator or by message control data from the interfaces.

In an alternative embodiment, not shown, the device is also arranged to assess characteristics of the target individual and use this assessment to trigger and/or control message delivery. In one alternative, by placing a sensor in the ceiling of the detection area, it is possible to determine the height of the target individual. The microcomputer 3 can then use this information to control message delivery. An ultrasonics arrangement, similar to the arrangement already described, is used. The signal return from a target to the sensor in the ceiling may then be used to determine the height of the target being detected by the device. Using this information, microcomputer 3 may make a determination as to whether the target is a child or an adult and control message delivery to deliver a message appropriate for the subject.

The technology is also presently available to detect and read RF ID Cards and Smart Cards being carried by the target person. The microcomputer can then use this information to dynamically vary message delivery and even message content. For example, the microcomputer may be programmed to control message delivery to refer to the target individual by name, if that information is available. For example, the device may be used at a trade show or exhibition and on entry to the exhibition each person may be presented with an RF card which contains information on the person. When the person approaches a device in accordance with the present invention, it is detected by the device and it is determined in accordance with the process of FIG. 3 that a message is to be delivered, in controlling message delivery, the microcomputer can take into account information obtained from the RF card, to personalize the message, or to address the message to a particular subject which it is apparent from the RF card information, the person is interested in.

One problem with the processing described with reference to FIG. 3, is that if one target leaves the detection area and shortly thereafter or at the same time another target enters the detection area, the barometer may continue incrementing as if the first target did not leave. This may result in message delivery to the incoming target prior to the optimum pre-message delay as determined by the set threshold level. The device fails to distinguish between the two separate targets.

In an improved embodiment (not shown) discrimination between multiple targets in the detection area is applied by dividing the detection area up into sections. For a three meter detection area, for example, the area is divided up into three sections, being zero to one meters from the device, one to two meters from the device and two to three meters from the device. This can be done because the distance from a target can be determined on the basis of the time it takes for the propagating ultrasonic signal to be reflected back to the receiver 37, 38. In other words, the return signal can be divided up into three separate detection areas depending upon propagation time. Each one of the separate detection areas can then be analysed separately by a similar process to FIG. 3, for each target that may be detected in the detection area. The first target to reach the threshold level may be the first one to cause message delivery and to avoid multiple message delivery to the other targets, the other processing in the other areas may be reset. In a situation where a target stands in the zero to one meter area for a time which is not sufficient to cause message delivery, and then leaves, and about the same time a further target comes into the one to two meter area, then the detection of the further target will not cause the device to act as if the first target has not left. Instead the separate processing in the one to two meter area will cause the barometer for that area to start from zero and the fact that the first target has left the zero to one meter area will result in the barometer for that area decrementing to zero. Different floor values will also be determined for each area, in accordance with the processing of FIG. 4 for each area.

Even finer discrimination may be carried out by placing a second transmitter and sensor arrangement such as that shown in FIG. 1 orthogonal to the first transmitter and sensor arrangement. The area in front of the second transmitter receiver arrangement is divided into sections, e.g., nought to one meter, one to two meters, two to three meters, which overlap with the sections of the first transmitter/receiver arrangement. The total detection area is thus divided into a grid and signals received from each sensor arrangement processed to determine placement of targets within the grid and control message delivery accordingly. This merely requires an increase in processing, but the basic processing would be in line with what has already been described.

The ability to discriminate within the detection area also enables an increase in versatility of message delivery control. Different messages may be delivered depending upon where a target is positioned. For example if a target is positioned quite a way from a product on a shelf, the message could be something along the lines of "come closer and take a look at this product". When the target comes closer, this will be detected and control delivery of a further message which is appropriate to follow the first message. With this improved arrangement, therefore, control of message delivery is increasingly versatile.

Where an area is sectioned, as discussed above, to avoid messages being delivered in accordance with more than one area, if a target is standing across adjacent areas, for example, some overlap in the sectioning is desirable for appropriate control to ensure that only one message is delivered.

As discussed in the preamble of the specification, message delivery is versatile both in method and timing of delivery and message content. Message data may be stored in the memory module EEPROM 12, and/or may be updated via replacement memory modules 11 or via the RS-485 interface or RS-232 interface 9. Control instructions may also be provided to the device in these ways, e.g., for controlling delivery of messages, detection parameters, etc. The device may be programmed to deliver a sequence of messages, if, for example, a person remains detected for a predetermined period of time. Timing between delivery of messages (pre- and post-message delays) is variable and may be set (via setting of threshold levels for barometer as discussed above) to effect simulation of a one way conversation from the unit to shopper, based upon the estimated duration of shopper's thought processes. As an example, a typical sequence may be as follows:

1. Message 1, barometer threshold corresponding to minimum three seconds continuous detection of person required before message is delivered "I can see that you are interested in this power drill! Why don't you pick it up, feel the weight and quality".
2. Message 2, barometer threshold corresponding to minimum five seconds in which continuous detection of the same person is required. "Yes, Australian technology and hard work. If you look on the side of the drill, you will notice the special attachments that come along with this unit".
3. Message 3, barometer threshold corresponding to minimum ten seconds delay between messages during which continuous detection of the same person is required. "Do you know that more Australian tradesmen use the ABC drill than any other drill? There is only one reason. Its the best!".

The device, once having delivered a message will not deliver a second message, until the individual in front of the unit has had sufficient time to consider the first message and act, either purchasing or moving onwards.

Following delivery of a message sequence the device will be reset, in accordance with the previous description (see description in relation to FIG. 4).

The pre-message and post-message delay capability ensures that the device does not deliver the same message to the same person before they have had the opportunity to make a purchasing decision.

By enabling the device to maintain different delay periods before and after each message is delivered, the device has the capacity to be able simulate conversation.

Control instructions determine whether the device treats a message as one of a sequence or a unique message and also determines whether the processing should enable the next message in the sequence to be delivered following that message or should reset the device at the start of the sequence of messages or, where only one message is to be delivered, reset so that the message will be repeated. The control of the barometer is applied by variation and control of the floor value in accordance with step 73 in FIG. 4. Where the message control instructions indicate that a further message is to be delivered then the floor value is reset and the barometer will start incrementing to the new threshold level as long as the target is present. This is discussed in detail above. If the target should leave during a message sequence, then the barometer will be decremented until it reaches the reset floor value. When this occurs, the microcomputer 3 determines that the target has left and resets the device to start from the beginning of the message sequence.

Storage/transmission of control instructions, including message delivery control, pre and post-message delays, etc., will be discussed later. Now a description will be given of the actual process of message reproduction.

The arrangement uses a digitizing method which is compatible with the requirements of MPEG 1 layer 2, at data rates of 32, 64, 96 and 128 kbps. Higher data rates and MPEG 1 layer 3 and MPEG 2 capabilities may be provided.

The audio delivery arrangement 5 comprises an MPEG audio decoder/volume control 42, amplifiers 35 and 36 and external speakers 31 and 32 as discussed above. Connections 40 and 41 for an external amplifier are also available in the device. MPEG is a known digital compression/decompression method for audio reproduction by computer. MPEG reproduction is very versatile including the ability to change bit rates during message delivery so that parts of a message can be delivered with higher quality than other parts of a message, so that some messages may have a higher quality than other messages, etc. Quality can thus be governed by the message control instructions.

The MPEG decoder 42 is controlled by the microcomputer 3. The MPEG decoder 42 contains its own RAM, but this is volatile. On start up, therefore, the microcomputer 3 is arranged to load the decoder 42 control software into the decoder 42 RAM.

When the microcomputer decides that a message is to be delivered (following the pre-message delay on detection of a target in the detection area) it selects and down loads the appropriate message data from where ever it is stored (see later) to the MPEG audio decoder 42, as the decoder 42 requires it. The MPEG data is decoded and the audio message is delivered via speakers 31 and 32.

As discussed above the device includes the capability of changing the MPEG data rate on the fly whilst reproducing a message, to allow sections of the message to be reproduced at higher quality at the expense of memory capacity. Volume is operator settable at at least seven steps of multiples of nominally 3 dB below 1 watt.

The MPEG standard is extremely flexible. All MPEG encoding of audio data may be done off site away from the device and down loaded to the device via the network facilities, via the flash card, loaded in via the EEPROM, via MODEM, etc.

As discussed above, message delivery is controlled in accordance with target detection, in accordance with any characteristics of the target which may have been determined, in accordance with position at which the target has been detected, in accordance with how long the target has been detected and whether the message to be delivered is one of a sequence of messages, etc. There are therefore a number of control parameters which may be available to the microcomputer 3 governing message delivery. Message control data therefore needs to be included corresponding to the control parameters. In addition to the control parameters discussed above, the device also includes a real time clock 13. Message delivery may also be governed by time of day and/or date. For example, on days of public celebration, such as Christmas, Easter, etc., or at least approaching Christmas and Easter, it may be required to vary the content of messages to accord with the date.

The device has the facility to select delivery of messages and/or order of delivery of a sequence of messages in accordance with some preset communication strategy over a relatively long period of time. For example, messages may be delivered as a function of time or day and date. The real-time clock 13 provides the microcomputer with the information it needs to establish time of day and date and to control message delivery accordingly.

Utilizing this function, the device may be programmed with certain messages for activation during the morning and other messages for the afternoon and evening.

Further, campaigns can be delivered in accordance with the date. For example, devices can have specific messages than will play over Christmas day, subsequent messages on Boxing day and other messages on New Years day.

In the preferred embodiment, control data and message data are stored on the flash memory card or down loaded via the network or stored on the EEPROM (which may be used as backup only—see later) to control message delivery in accordance with detection of targets in the detection area. Each message to be delivered may include the following control and message data:

1. Pre and post-message delay parameter, governing the pre and post-message delay for the message.
2. Minimum and maximum range setting. Where the message is one within a sequence of messages following the first message that has been played, if the deteactor detects that the target is not within the range specified by this parameter, it will not play the message and the device will be reset to play at the beginning of the message or sequence on the detection of the next target. The range flag can be set to cover the entire detection area.
3. Right and left channel volume. This will indicate the volume at which the message is to be delivered.
4. Pointer to next message where the next message is in a sequence and the target remains in the detection area. This will indicate where the processor will find the next message if the target remains in the field.
5. Pointer to next message if the target leaves the detection area during delivery of sequential messages. This pointer can be set to point to any message desired and thus provides great versatility. It may point back to the beginning of the message sequence so that the message sequence starts again when a further target is detected or may point to any other stored message. For example, if a person leaves at this particular point in message delivery it may decide to go to an alternative message rather than back to the beginning of the sequence, so that an alternative message will be played the next time a target enters the detection area.
6. Is the message a "normal trigger" message or a "non-trigger message". A non-trigger message is one which follows automatically in sequence from a preceding message. It will play regardless of what has occurred previously and merely follows in sequence from the preceding message. When the device is reset it will never be reset to start on a non-trigger message. It will reset to start on a normal trigger message.
7. Message type flag. There are a number of alternatives which include a normal annunciation type (normal audio delivery), a text string type (delivered visually by a display as a text string) or statistical message type. Where the message type is a statistical message type, it merely means it is a space in memory which is to be used to store statistics gathered by the device on the amount of targets passing by, a number of message delivery occurrences, etc., (see discussion on statistical gathering, in this description). In a preferred embodiment, where flash card memory is used for message data and statistical storage, a statistical storage space is merely defined as "messages" which are flagged as a statistical type. This space will be identified by the microcomputer to down load statistical data 202. If more space is needed, the operator can determine to include more space of the statistical message type.

More complex control parameters may also be included to increase the versatility of message delivery.

The pre and post-message delay parameter is a particularly important feature as it governs the timing of delivery of messages. As discussed previously, the "impact" of any message is affected greatly by the timing of the delivery of the message. The ability to manipulate pre and post-message delays, therefore, is an important one. In the message data, each message is stored with its pre and post-message delay data. Note that the pre and post-message delay data may indicate no (i.e., zero) pre and/or post-message delay.

Pre and post-message delays may be varied for each message in two general ways. In the long term, by updating the pre and post-message delay via one or other of the interfaces (e.g., via RS-485 network, flash card 11, etc.,) for each particular message. In the long term, the microcomputer 3 is arranged to override pre and post-message delay information to ensure that a minimum number of messages are delivered over a predetermined time, and/or less than a maximum number of messages are delivered in a predetermined period of time.

In the long-term, pre and post-message delays may be controlled in response to market research as to the effectiveness of message delivery via the device 1. Market research will be based upon statistical analysis of the number of triggers of a device with regard to the number of people passing by the device and the number of people making a purchase of the relevant product. The device includes the facility to gather statistics (see later). Further marketing information may include comparisons between areas with similar psychographics/demographics where the devices are placed to determine whether there is any difference in reaction to the relevant product if pre and post-message delay is different.

As a result of this long term market analysis, the pre and post-message delays can be optimised. Similarly, message content and other control parameters can also be optimised.

In short-term, the device also has the capacity to automatically alter its pre- and post-message delay settings in response to the changes within the operating environment detected by detector 6 and microcomputer 3. For example, during periods of heavy customer traffic (where many detections are being made over short periods of time) pre- and post-message delay time may be increased by the microcomputer to prevent the unit from activating too often and thus causing inconvenience to the retailer.

The device may also lower its settings to meet some arbitrally set number of activations as a function of time, ie. the number of messages per hour must be greater than "X".

The device, therefore, maintains a dynamic response in message delivery depending upon the changes in the operating environment.

The device may also maintain the capability of altering the pre- and post-message delays as a function of time. The device may be primed to ensure that it activates at some minimum and maximum levels as a function of time (ie. a number of activations per hour). The unit may adjust its setting to ensure that it activates at least X times per hour, or does not activate more than X times per hour.

This operation is achieved by appropriate control software for the microcomputer 3, as will be appreciated by the skilled person. Software which ensures maximum and minimum levels of operation will override other operation of the device.

The device can also be arranged to deliver a message depending upon the number of people who have passed by the device without remaining in the detection area long enough for normal message delivery, for example. In this case, if a predetermined number of people pass by the device without the device being triggered, the device may, on the next person approaching and passing through the detection area, be arranged to deliver a predetermined message.

The capability to program messages in sequence gives the user significant control over how it wishes to communicate to shoppers through the combinations in sequencing and delays.

This ability to maintain control of the manner in which messages are delivered provide the unit with the flexibility to be able to offer clients (users) a point of sale communication medium.

This is particularly relevant as campaigns at point of sale will then be able to reflect campaigns that may be occurring in parallel on television according to the date at which new television commercials are released.

As well as delivering audio messages, as discussed above, via the RS-232 interface 9, the device may control delivery of visual messages, may control electromechanical objects to move, may control interactive PC's and may control other devices.

Control of visual messages may be done via a special control parameter associated with a message to be delivered e.g., a "video" control parameter that indicates when a particular message is to be delivered there is an associated video message which the micro computer 3 must go and fetch and use to control the delivery of a visual message via the RS-232 interface.

In this embodiment, the device also has an information gathering function to assist with planning marketing campaigns. The microcomputer 3 is arranged to gather statistics on the following events:

(a) the total number of detector activations i.e., the number of times the detector detects that a target has entered the detection area.

(b) the number of message delivery activations, i.e., the number of times that a target remains in the area for a sufficient length of time to cause a message to delivered.

The microcomputer 3 is arranged to gather the statistics and load them into a memory (in the preferred embodiment into the flash card 11), typically every 15 minutes. The statistics may alternatively be down loaded to a terminal modem via an RS-232 or to the network via RS-485.

From these statistics, information can be gathered on how many people impliedly expressed interest in the product to be marketed as compared with the number of people that by-passed it. Together with purchasing information on the product, this can provide a total picture for the client of the success of his marketing campaign. This information can be used actively to adjust the marketing campaign while it is ongoing and can also be used to actively adjust pre and post-message delays, as discussed above.

Other statistical information can be directional, ie. direction of approach of persons to the devices, where sensors are arranged to provide direction information (two separate groups of ultrasonic sensors 2 may be provided slightly separated from each other to determine approach direction of a detected target), which can give some direction of flow information for retail store management to plan the layout of their store.

Associated with the statistical information shall be identification of the device by an address or serial number, the time and date at which statical gathering commenced and the time and date of the last statistical data update.

The rate at which statistical data is updated in the memory module is limited to prevent an excessive number of write cycles occurring for any memory block.

As discussed above, a plurality of the devices of FIG. 1 may be connected in a network, each device having an individual address, to facilitate conducting marketing campaigns. Such a marketing system provides a novel method of marketing a product or service. Each device in a network is provided with an address (unit identification number). This also serves to act as a method of security to prevent vandalism, or interruption to a clients campaign by a competitor. It also serves a safety mechanism to ensure that the correct unit receives the corresponding campaign messages, not messages belonging to a different clients device. It also serves as an imperative characteristic in the tracking and monitoring across numbers of stores, each containing numbers of units. It also enables statistical data retrieved from the units to be interpreted based upon such general classifications such as all those belonging to retail group A, compared to retail group C, or all those units belonging to a client on a national basis, or a range of clients across a series of products with a single industry category, for example comparative results for the software industries as opposed to the electronic goods industry.

Figure 5:
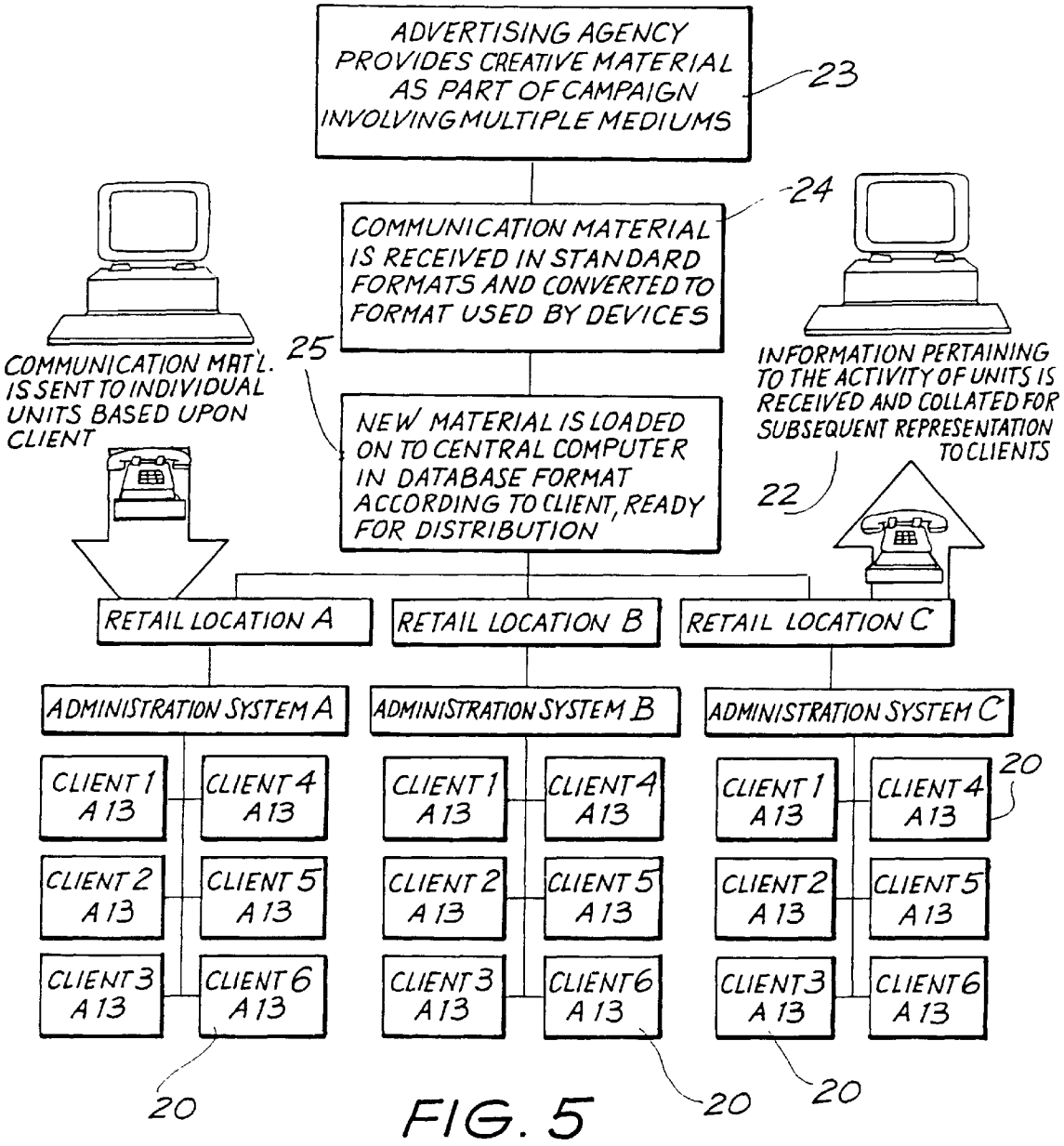
FIG. 5 is a schematic block diagram of a marketing system in accordance with an embodiment of the present invention for illustrating operation of such a system.

FIG. 5 schematically shows such a network and also illustrates one optional way of running a marketing campaign via the network.

A number of marketing devices 20 in accordance with an embodiment of the present invention are located at three separate retail locations, A, B and C. Each individual device may be associated with a particular client for marketing that client's particular product or service. The diagram shows six devices for each retail store, each device belonging to a separate client. It will be appreciated that more than one device may operate for the same client and that there may be more than six devices at each retail location. FIG. 5 is an example only.

Each device is separately addressable by its respective controller, via administration system A, B or C. The message data may be sent to individual units 20 based upon client requirements, 21, via modem and telephone line. At each retail location, a modem and PC is connected to communicate with a control at a central location which provides the instruction data and message data updates and receives information pertaining to the activity of the units (statistical information). The PC at each retail location i.e., the administration system, is connected via the RS-485 interface to each device at the retail location in a daisy chain network.

Information pertaining to the activity of each of the devices 20 (statistical information as discussed above) is received via modem and collated for subsequent presentation to clients 22.

An advertising agency or the like provides creative material as part of a campaign involving multiple media, for example, 23. This creative material is received in standard formats and converted to message data and/or control data for use by the devices 24 and this is loaded on a central computer database formatted according to client, ready for distribution to each device 25 via modems 21 and administration PC's A,B,C.

As discussed in the preamble of the specification, this enables an organised marketing campaign to be carried out, enables each device to be separately updated with message data and control instructions and enables the marketing campaign to be amended in response to statistical information gathered from the devices.

Figure 6:
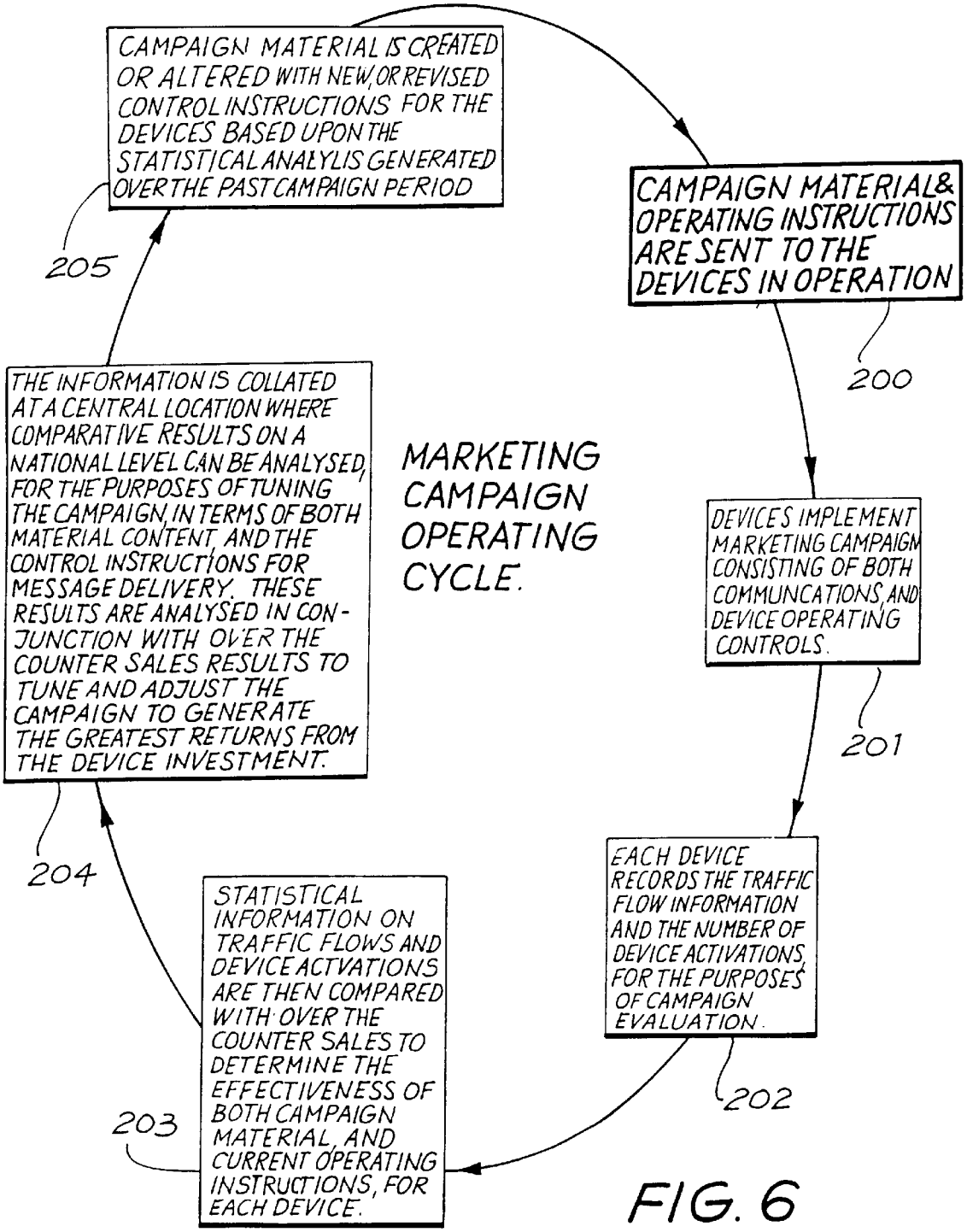
FIG. 6 is a flow diagram illustrating operation of the system in accordance with a method of an embodiment of the present invention, for applying a marketing campaign.

A "marketing campaign operating cycle" in accordance with a method of the present invention, utilising devices in accordance with the present invention, is illustrated schematically in FIG. 6. On initiation of a marketing campaign, campaign material (message data etc.,) and operating instructions are sent to the devices in the field which are to take part in the campaign (step 200). At 201, the devices implement the campaign. Each device is arranged to record and store statistical information on traffic flow (the number of persons passing through the detection area of the device) and the number of device activations (the number of times that a message is delivered to a target), step 202. This information is returned to the campaign coordinator who may compare the traffic flows and device activations from the plurality of devices in the field with over the counter sales information to determine the effectiveness of both the campaign material and the current operating instructions for each device, step 203. This information is collated at a central location where comparative results on a national level can be analysed, for the purposes of tuning the campaign, in terms of both material content and the control instructions for message delivery. Analyzing the results in conjunction with over the counter sales results to tune and adjust the campaign to generate the greatest returns from the device. The control instructions, as discussed above, include setting of pre and post-message delays for each message to give optimum impact of message delivery timing. Step 204. Campaign material is created or altered with new, or revised control instructions (including pre and post-message delays) based upon the statistical analysis, and these are then delivered to each device, step 205.

The ability of the device in the market to collect statistical information is a very important one. Present methods to record effectiveness of a marketing campaign generally require an individual to be present at some location and individually track and monitor the number of shoppers or passers by, recording the information manually. The device of the present invention will collect this statistical information without this additional effort being required.

The other interfaces provided for the device 1 enable a number of other control options.

Firstly, to conduct marketing campaigns it is not necessary to have the plurality of devices 1 connected in a network via the RS-485 or RS-232 interfaces. The campaign can be conducted from a central location by using the flash card memories 11. When it is wished to update message/control data the replacement flash card memory can be loaded and placed in the device 1. Each device 1 used in such a marketing campaign will still be identified by its own unit identification number. The statistical information required for the campaign would be obtained from the down loaded flash card memory.

The RS-485 network may also be used to connect adjacent devices for coordinated message delivery operation. For example, a first device could be placed at the bottom of a supermarket isle and second device placed further up the supermarket isle. The devices would be connected by the RS-232 interface. If a first device detects a target and delivers a message it will communicate this information via the RS-232 to the second device which, when it detects a target approaching from down the isle, will be arranged to deliver an appropriate message related to the first message. The plurality of devices can thus be coordinated within a store, to give a coordinated campaign.

Yet a further option for the present invention, is to have message delivery and control instructions permanently loaded on a PC connected to a plurality of devices in a store via the RS-485 network. When a device determines that a message is to be delivered, it asked the PC for appropriate message data and control data. Message delivery can therefore be controlled from a central location.

The device in accordance with the present invention can also operate in an "eyes-only" mode. In this mode, the device merely acts as a detector and determination means to detect that a target has entered a detection area and determine that the target may be interested in a particular product (see earlier). Message delivery can then be controlled via any normal message delivery device, such as video, computer, etc. The device is essentially the same it is the message delivery element of it which is different from what is previously been described.

Another improved embodiment will incorporate voice recognition software, which is available at a simple level, becoming more complex. This will enable a device to operate a two-way conversation with a target. For example, the device may deliver a communication that ends with "if you would like more information on this wine, say "yes". A simple voice recognition process would be able to recognise the word yes, or simple numbers. Further information would be delivered depending upon the voice response of the target.

EEPROM 12 is used to store backup message data and control data which will be used to control the message delivery in default of other information being available. It may include message data control data specified by the client as suitable backup message data should no special marketing campaign be being carried out, for example.

In the preferred embodiment, as discussed above, the message and control data is provided on a flash memory card. An example structure of the data stored on the flash memory card and details of message retrieval from the storage on the memory card is given in the following:

Message Retrieval from and Storage to the Memory Card

1. Information about the structure of the data stored on the memory card is stored on the memory card (at a fixed address so it can be easily found). This block of information is called the Memory Card Information Block (MCIB). The MCIB is read by the microcontroller to find details about the structure of info stored on the card when the system starts and whenever necessary at other times. These details include the location and size of the first Message Information Block (MIB). There is only one MCIB on a card, there can be a large number of MIBs on the card.

2. Each MIB contains details of a message. This message may be an audio message (stored in MPEG format) a text message, a statistics block or other message type. Each message is defined by its location and length. The location is the address in the memory card of the first byte of the message and the length is the number of bytes in the message. The collection of MIBs forms the directory of messages on the card. Each MIB is of fixed size (the size and number of messages is given in the MCIB), so the microcontroller can skip through the MIB determining what each message is used for (it's type) and where the message data is stored on the card.

3. Each MIB also contains information on the required pre and post message delays, the range settings, message linking information (for threads or conversations) and other information such as discussed above.

4. Each MIB has a fixed structure. This means, for example, that the location for a message can be found at the nth byte of the MIB and is m bytes long. The values of n and m depend on the version of the MIB structure being used. The MCIB signals to the microcontroller the version of the memory card structure so allowing future changes to the MCIB and MIB to be accommodated. Unused parameters are programmed to a default state indicating to the microcontroller they have not been set.

5. Currently all MIBs on a card are the same length and structure. In future it is possible that the MIB for a message may vary in length according to the message type it is describing. The length of the MIB may even vary in length if a method of indicating the length of the MIB is put into the MIB. This structure for the MIB would also allow unprogrammed parameters to be left off the card rather than being programmed to default states as is currently required. Each parameter in the MIB would be indicated by a bytes or bytes indicating to the microcontroller the length and type of data that follows. In this scenario, not implemented but a possibility for the future, both the NIBs and the information within the MIB would be structured as linked lists.

6. When the microcontroller determines which message will be played next it retrieves from the MIB details such as required pre-message delay and minimum and maximum range settings that are required by the detection algorithm.

7. The detection processes can then be started to determine the presence, absence or in the case of retrigger events, continued presence of object in the field of view.

8. The read of the MIB in step 4 will also give the location and length of the message to be played when a detection has occurred. Once the detection has triggered the replay of an audio message, for instance, the microcontroller can dump the message byte by byte to the audio replay hardware using the information on message location (address in the memory card) and its length (number of bytes in the message).

9. Not all messages are audio messages. Blocks of memory can be reserved by defining a statistics message, as discussed above. This gives the microcontroller space on the memory card to record the statistics of the detection process. There can be more than one statistics block defined on the card. To find the next available statistics block the microcontroller searches through the MIBs to find one that describes a statistics block.

10. Other messages such as associated text messages can also be defined. The MIB for each message contains information particular to the message type—as an example a statistics block does not need pre and post-message delays settings.

11. Each MIB has been reserved to allow the microcontroller to send some details about a message back to the memory card programming studio. This may be used to indicate the message was corrupted or something similar.

12. Once a message has finished playing the post-message delay period is entered by the system. Depending on information stored in the MIB for the (just finished) message several message may be the next to play. The MIB has fields pointing to the MIB of the next message to play if the field goes empty (sequence terminating) and one pointing to the MIB of the message to play if the field is still full (a retrigger even or a sequence or conversation continuing). The microcontroller makes use of the detection parameters retrieved from the just finished message and information returned from the ultrasonic detectors to decide which message to play next.

13. In the case of a retrigger event (field did not go empty after the previous message's post-message delay) causing a conversation or sequence to continue the microcontroller may ignore the pre-message delay and immediately play the message. Some other parameters may also be ignored but some such as the message linking information and volume etc., would be used.

14. Once a message in a sequence has finished playing the microcontroller must decide on what actions are allowed. If the MIB for the message does not define another message in the sequence then the system assumes the sequence has finished and should not normally trigger again until a new sequence is started (field must go empty before the next detection is allowed). If a retrigger message is defined in the MIB then the system can read the parameters for that message and be prepared to play it if the field is still full at the end of the post message delay that is currently counting down. Should the field go empty before the post message delay is finished then the system would go to the message defined in the just finished messages MIB as the next normal trigger message (as opposed to that defined as a retrigger message). In other words the message linking to form conversations is done by each message providing the number of the MIB of the messages to play in the different cases of the field remaining full (retrigger event) or the field going empty then a new detection being recorded (normal detection). If a message does not define either a next normal message or a next retrigger message then the system can use a pre-programmed sequence to determine which message to play next.

15. It is possible that in future a new message type could be defined which would define the desired sequence. In this case the message, a sequence message type, would probably override any sequence stored in the MIB's. Storing sequence information in this way would allow the possibility of defining multiple sequences that could be played at different times of days or on different dates (Christmas Eve for instance). The structure of the sequence message would define the conditions under which it was to be used and the information on message linking to form threads. The system would still need to access each messages MIB to find the location and length of the message to be played once it is triggered.

16. An MIB does not need to define all parameters of a message. If some are left undefined then the microcontroller uses default parameters it has stored or retrieved from the EEPROM.

As discussed above, the EEPROM stores the default parameters which can be used if information is not available in the MIB.

Variations and/or modifications may be made to the invention as shown in the specific embodiments without departing from the spirit or scope of the invention as broadly described. The present embodiments are, therefore, to be considered in all respects as illustrative and not restrictive.

We claim:

1. A message delivery marketing device, comprising a detection means for detecting the presence of a person proximate a predetermined object or at a predetermined location, a determination means responsive to action of the person to determine whether or not a message should be delivered, and audio and/or visual message delivery means responsive to the determination means determining that a message should be delivered, to deliver a predetermined message, wherein the determination means is arranged to be responsive to the person remaining proximate the object or at the location for an adjustable predetermined time period following the detection means detecting the presence of the person, to determine that a message should be delivered, the predetermined time period being sufficient to establish that the person is likely to be interested in a product or service associated with or proximate the device.

2. The device in accordance with claim 1, further comprising a message storage memory for storing a plurality of messages for delivery by the device.

3. The device in accordance with claim 1, being arranged to reset to start at the beginning of a message, following the detection means detecting that a person is no longer present.

4. The device in accordance with claim 1, further comprising environment assessment means arranged to detect any static changes in the detection area of the detection means and to control message delivery in accordance with any static changes.

5. The device in accordance with claim 1, wherein the determination means includes character assessment means for assessing characteristics of a person detected by the detection means and for controlling message delivery accordingly.

6. The device in accordance with claim 1, further including message selection means for selecting the message to be delivered by the device, depending upon predetermined criteria.

7. The device in accordance with claim 1, further including statistical gathering means for gathering information on the operation of the device.

8. The device in accordance with claim 7, wherein the statistical gathering means is arranged to gather and store information on the number of times a person is detected and the number of times messages are delivered.

9. The device in accordance with claim 1, comprising communication means enabling a plurality of the devices to communicate with a central controller whereby to enable updating of messages and/or updating of control instructions and/or down loading of instructions/information stored in the devices.

10. The device in accordance with claim 9 wherein the communication means includes an updatable memory interface enabling updating of message information and/or control instructions and down loading of information stored in the device.

11. The device in accordance with claim 7, wherein the statistical gathering means is arranged to gather and store information on the duration of time spent by persons proximate the device listening to messages.

12. The device in accordance with claim 9, wherein the communication means is arranged to enable downloading of statistical information gathered by the device.

* * * * *